US006883285B2

(12) United States Patent
Chen

(10) Patent No.: US 6,883,285 B2
(45) Date of Patent: Apr. 26, 2005

(54) PLASTIC POST ASSEMBLY FOR MAILBOX

(76) Inventor: Chang Than Chen, 12F, No. 426, Ming Chuan 2nd Road, Chien Chen Chu, Kaohsiung (TW), 806

( * ) Notice: Subject to any disclaimer, the term of this patent is extended or adjusted under 35 U.S.C. 154(b) by 96 days.

(21) Appl. No.: 10/401,628

(22) Filed: Mar. 27, 2003

(65) Prior Publication Data

US 2004/0187415 A1 Sep. 30, 2004

(51) Int. Cl.[7] ..... B04C 1/10; A45F 3/44

(52) U.S. Cl. ..... 52/309.9; 52/301; 40/607.4; 248/156; 248/219.3

(58) Field of Search ..... 248/156, 530, 248/536, 218.4, 219.2, 219.3; 52/301, 169.13, 309.9, 309.1, 309.8, 309.4; 40/607.04, 607.06, 607.05

(56) References Cited

U.S. PATENT DOCUMENTS 4,216,634 A * 8/1980 Binder ..... 52/309.9
4,843,746 A * 7/1989 DesNoyers et al. ..... 40/607.04
4,951,904 A * 8/1990 Obenshain ..... 248/156
5,076,032 A * 12/1991 Lehman ..... 52/169.13
5,078,367 A * 1/1992 Simpson et al. ..... 256/24
5,305,976 A * 4/1994 Blanchard ..... 248/156
5,340,065 A * 8/1994 Thomas ..... 248/150
5,457,929 A * 10/1995 Kim ..... 52/721.4
5,489,076 A * 2/1996 Thomas ..... 248/150
5,524,853 A * 6/1996 Varlaro ..... 248/145
5,620,136 A * 4/1997 Erwin et al. ..... 232/39
5,903,991 A * 5/1999 Sasse ..... 40/607.04
6,518,363 B2 * 2/2003 Kanzaki et al. ..... 525/240

* cited by examiner

*Primary Examiner*—Leslie A. Braun
*Assistant Examiner*—Tan Le
(74) *Attorney, Agent, or Firm*—Charles E. Baxley

(57) ABSTRACT

A plastic post device for mailboxes includes a tubular member having a depression formed by a stem, a conduit having a recess formed by another stem. The recess of the conduit is aligned with the depression of the tubular member, and the stems of the tubular member and the conduit are engaged with each other, to laterally secure the conduit to the tubular member. The tubular member and the conduit each include an inner portion having a less specific weight than that of an outer peripheral covering which includes a ultraviolet absorber material and an anti-oxidation agent for protecting the post device from being rusted or damaged.

1 Claim, 2 Drawing Sheets

PLASTIC POST ASSEMBLY FOR MAILBOX

BACKGROUND OF THE INVENTION

1. Field of the Invention

The present invention relates to a plastic post assembly, and more particularly to a plastic post assembly for supporting mailboxes or the like.

2. Description of the Prior Art

Various kinds of typical posts have been developed and provided for supporting mailboxes or the like. Some of the typical posts are made of wood materials, and will be easily rotted, after use, by sun shines, rains, etc. For example, after raining, the rain or other water may permeate into the wood posts and thus to easily and quickly rot the wood posts.

In the snowy environment, the rain or other water that permeates into the wood posts may be froze into ice and may thus to have an increase volume that may crack the wood posts, and may cause the wood posts to be further quickly rotted.

The other typical posts are made of metal materials, and will be easily rusted, after use, by sun shines and/or rains, etc. In addition, the typical posts that are made of metal materials may include a great strength that may not be easily cut or bent or machined, and thus may not be easily manufactured and installed by the users themselves.

In addition, the typical posts that are made of metal materials may include a greater weight that is adverse for transportation purposes.

The present invention has arisen to mitigate and/or obviate the afore-described disadvantages of the conventional post devices for mailboxes.

SUMMARY OF THE INVENTION

The primary objective of the present invention is to provide a plastic post assembly for easily supporting mailboxes or the like.

The other objective of the present invention is to provide a plastic post assembly including a sun shine and rain and heat endurable structure for allowing the posts to be easily carried or moved and assembled by the users themselves.

The further objective of the present invention is to provide a plastic post assembly which is made of plastic materials and which may be easily cut or machined and assembled by the users.

In accordance with one aspect of the invention, there is provided a plastic post assembly comprising a tubular member including a bore formed therein, and including a middle portion having a depression formed therein and defined by a stem, a conduit including a bore formed therein, and including a middle portion having a recess formed therein and defined by a stem. The recess of the conduit is aligned with the depression of the tubular member, and the stems of the tubular member and the conduit are engaged with each other, to laterally secure the conduit to the tubular member. The tubular member and the conduit each include an inner portion made of a foaming agent, a foam adjusted agent, a filler material, and a processing aid agent, and include a specific weight of 0.45–0.6, and each include an outer peripheral covering made of a foaming agent, a foam adjusted agent, a processing aid agent, a ultraviolet absorber material, and an anti-oxidation agent, and include a specific weight of 0.55–0.65.

The tubular member includes an open top, and a cover attached on top thereof, to enclose the open top thereof. The conduit includes at least one open end, and a cap attached onto the conduit, to enclose the open end of the conduit. The conduit includes an end having an inclined surface formed therein.

One or more fasteners may further be provided and engaged through the tubular member and the conduit, to further solidly secure the tubular member and the conduit together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
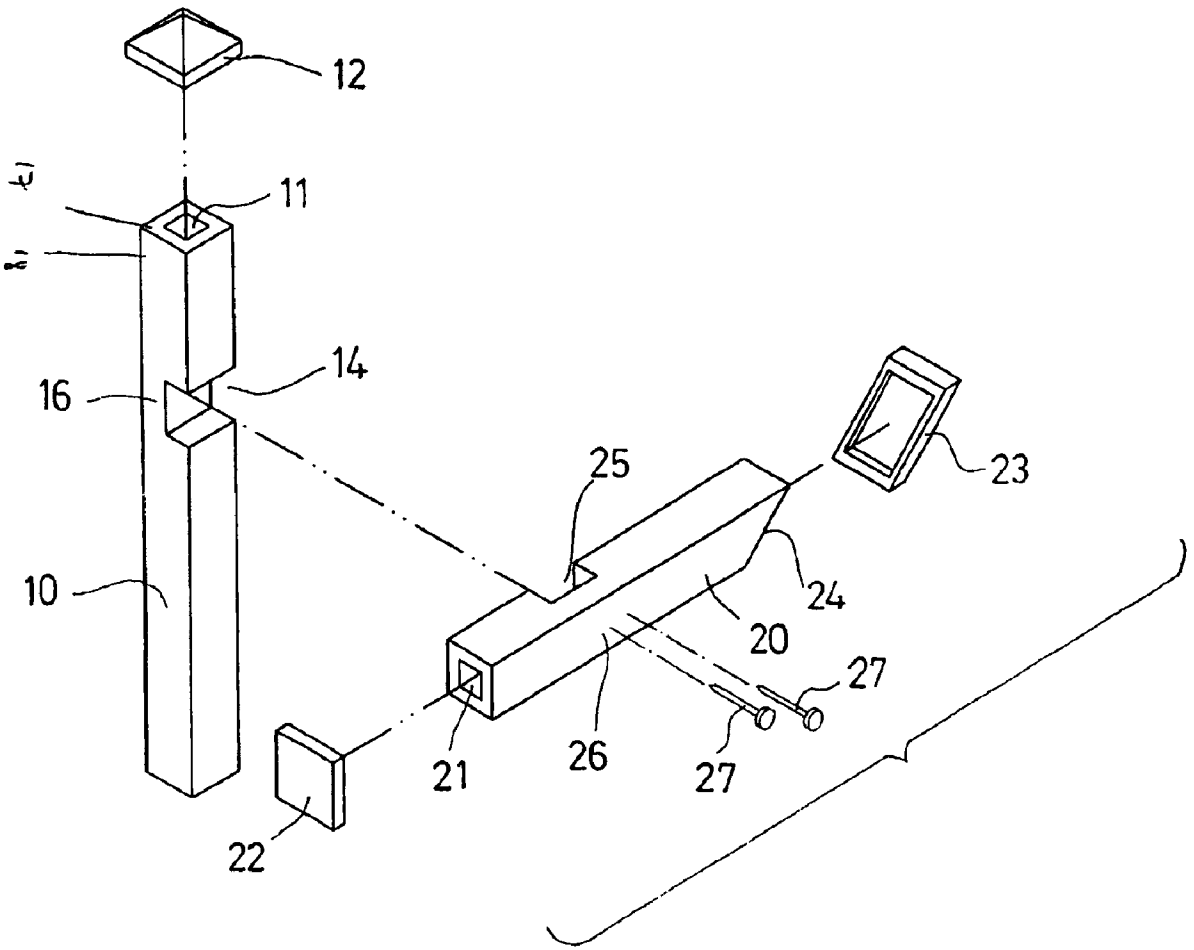
FIG. 1 is an exploded view of a plastic post assembly in accordance with the present invention.
Figure 2:
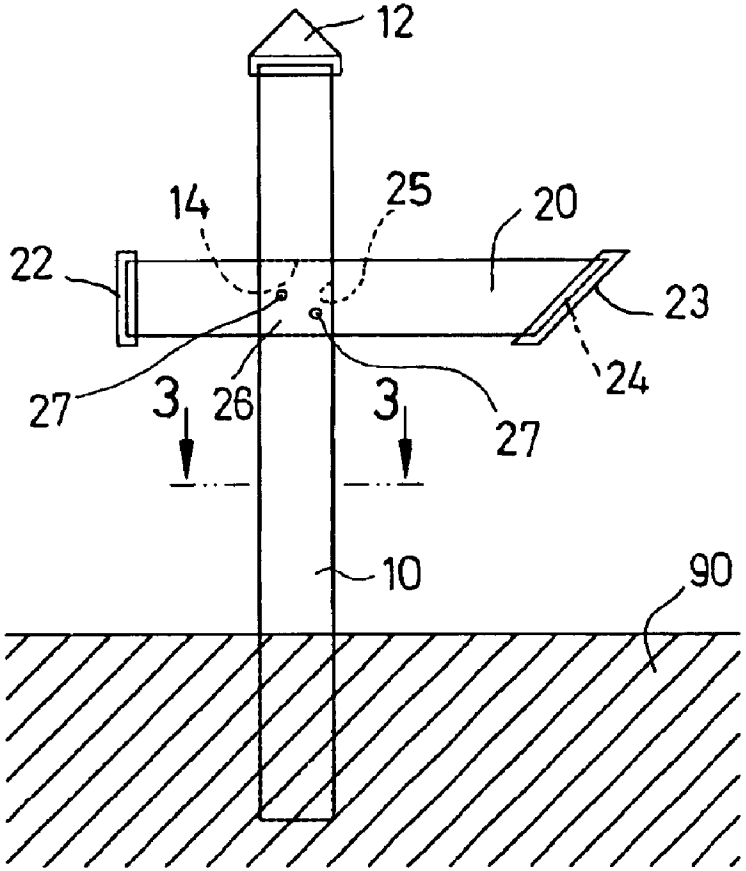
FIG. 2 is a plan view of the plastic post assembly.

Referring to the drawings, and initially to FIGS. 1 and 2, a plastic post assembly in accordance with the present invention comprises a longitudinal or vertical or tubular member 10 including a bore 11 formed therein and including an open top that may be enclosed and/or sealed with a cover 12. The tubular member 10 includes a depression 14 formed in the middle portion thereof, to form or define a thickness reduced stem 16 in the middle portion thereof.

The plastic post assembly further includes a lateral conduit 20 having a bore 21 formed therein and having two open ends that also may be enclosed and/or sealed with caps 22, 23 respectively. The conduit 20 includes a recess 25 formed in the middle portion thereof, to form or define a thickness reduced stem 26 in the middle portion thereof. It is preferable that the conduit 20 includes one or both ends each having an inclined surface 24 formed therein, and facing downwardly, for preventing rain or water from flowing into the conduit 20.

When assembling the tubular member 10 and the conduit 20 together, the depression 13 of the tubular member 10 is aligned with the recess 25 of the conduit 20, and the stems 16, 26 of the tubular member 10 and the conduit 20 are then contacted or engaged with each other. The tubular member 10 and the conduit 20 may be secured together with such as force-fitted engagements, adhesive materials, or the like, or may be secured together by welding processes.

One or more fasteners 27 may further be provided and engaged through the tubular member 10 and the conduit 20, in order to further solidly secure the tubular member 10 and the conduit 20 together.

Figure 3:
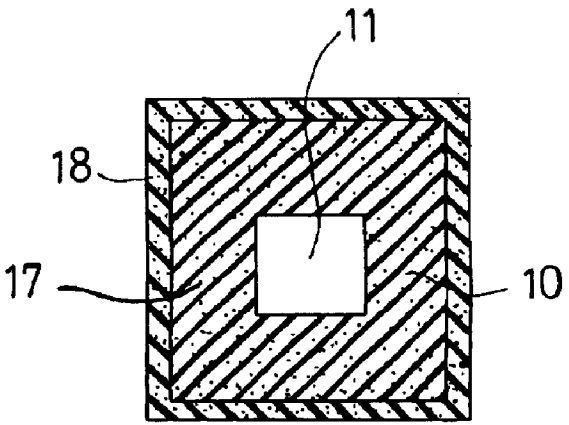
FIG. 3 is a cross sectional view taken along lines 3—3 of FIG. 2, illustrating the operation of the plastic post assembly.

As shown in FIG. 3, the tubular member 10 and/or the conduit 20 may preferably be made of plastic materials and/or foamable materials, and may include a body or inner tubular portion 17 and an outer peripheral covering 18. The inner tubular portion 17 of the tubular member 10 and/or the conduit 20 may primarily include a plastic or foaming agent, a foam adjusted agent, a filler material, a processing aid agent that are mixed or blended together.

The outer peripheral covering 18 of the tubular member 10 and/or the conduit 20 may include a plastic or foaming agent, a foam adjusted agent, a processing aid agent, a ultraviolet absorber material, and an anti-oxidation agent that are mixed or blended together, for preventing the tubular member 10 and/or the conduit 20 from being oxidized or rusted or from being damaged by ultraviolet rays or the like.

The inner tubular portion 17 of the tubular member 10 and/or the conduit 20 may include a specific weight of about 0.45–0.6, and the outer peripheral covering 18 of the tubular member 10 and/or the conduit 20 may include a specific weight of about 0.55–0.65, for allowing the tubular member 10 and/or the conduit 20 to be easily cut or machined and assembled. The tubular member 10 and the conduit 20 may thus include a reduced weight that is excellent for transportation purposes.

In addition, the outer peripheral covering 18 of a greater specific weight may include a greater strength than that of the inner tubular portion 17 of the tubular member 10 and/or the conduit 20, for effectively protecting the tubular member 10 and/or the conduit 20 from being oxidized or rusted or from being damaged by ultraviolet rays or the like.

The tubular member 10 and/or the conduit 20 may be formed by molding, hot-pressing, mold injection, or mold protruding processes, or the like. For example, the materials for manufacturing or making the tubular member 10 and/or the conduit 20 may be heated up to about 130–180° C., and may then be protruded and secured together to form the required configurations or contours.

In addition, the outer peripheral covering 18 of the tubular member 10 and/or the conduit 20 may include or may be formed with various kinds of shapes, colors, patterns, such as wood vein patterns thereon.

The plastic post assembly may be provided for supporting mailboxes (not shown) or the like, and include a structure that may resist sun shines, and rains, and heats, and includes a reduced weight for allowing the posts to be easily carried or moved and assembled by the users themselves. The plastic post assembly is made of plastic materials and may thus be easily cut or machined and assembled by the users.

Accordingly, the plastic post assembly in accordance with the present invention may be used for resisting sun shines, and rains, and heats, and may be easily cut or machined and assembled by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A plastic post assembly comprising:

a vertical tubular member including a bore formed therein, said tubular member including a first end and a second end, and said bore of said tubular member being opened through said first end and said second end of said tubular member, and including a middle portion having a depression-formed therein and defined by a thickness reduced stem, said tubular member including an open top, a cover attached on top of said tubular member to enclose said open top and said bore of said tubular member, a lateral conduit including a bore formed therein, and including a middle portion having a recess formed therein and defined by a thickness reduced stem, said recess of said conduit being aligned with said depression of said tubular member, and said stems of said tubular member and said conduit being engaged with each other, to laterally secure said conduit to said tubular member, and said conduit including a first end and a second ends and said bore of said conduit being opened through said first end and said second end of said conduit said second end of said conduit including an inclined surface formed therein and facing downwardly for preventing rain from flowing into said conduit, two caps attached onto said first end and said second end of said conduit, to enclose said first end and said second end of said conduit, and at least one fastener engaged through said stems of said tubular member and said conduit, to secure said tubular member and said conduit together, and said tubular member and said conduit each including an inner tubular portion extended longitudinally and entirely through said first end and said second end within an outer covering of each tubular member and conduit and made of a foaming agent, a foam adjusted agent, a filler material, and a processing aid agent, and including a specific weight of 0.45–0.6, and each including an outer peripheral covering made of a foaming agent, a foam adjusted agent, a processing aid agent, a ultraviolet absorber material, and an anti-oxidation agent, and including a specific weight of 0.55–0.65.

* * * * *